US005391101A

United States Patent [19]

Aebi et al.

[11] Patent Number: 5,391,101

[45] Date of Patent: Feb. 21, 1995

[54] METHOD OF MANUFACTURING A FEEDBACK LIMITED MICROCHANNEL PLATE

[75] Inventors: Verle W. Aebi, Menlo Park; Kenneth A. Costello, East Palo Alto, both of Calif.

[73] Assignee: Intevac, Inc., Santa Clara, Calif.

[21] Appl. No.: 135,014

[22] Filed: Oct. 12, 1993

Related U.S. Application Data

[62] Division of Ser. No. 724,041, Jul. 1, 1991, Pat. No. 5,268,612.

[51] Int. Cl.[6] ..... H01J 9/12

[52] U.S. Cl. ..... 445/50; 445/51

[58] Field of Search ..... 445/50, 24, 51

[56] References Cited

U.S. PATENT DOCUMENTS

| | | | |
|---|---|---|---|
| 3,260,876 | 7/1966 | Manley et al. | 313/103 CM X |
| 3,374,380 | 3/1968 | Goodrich | 313/103 CM |
| 3,634,712 | 1/1972 | Orthuber | 313/105 CM X |
| 3,870,917 | 3/1975 | Cuny | 313/105 |
| 3,898,498 | 8/1975 | Stone et al. | 313/105 |
| 4,126,813 | 11/1978 | Orthuber | 315/11 |
| 4,267,442 | 5/1981 | Rosier | 313/103 |
| 4,945,286 | 7/1990 | Phillips et al. | 313/105 |
| 4,950,940 | 8/1990 | Woodhead et al. | 313/103 |
| 4,978,885 | 12/1990 | White et al. | 313/103 |
| 5,023,511 | 6/1991 | Phillips | 313/528 X |

FOREIGN PATENT DOCUMENTS

| | | | |
|---|---|---|---|
| 119337 | 9/1980 | Japan | 313/103 CM |
| 2244853A | 12/1991 | United Kingdom | 445/50 |

OTHER PUBLICATIONS

N. Koshida, Effects of Electrode Structure on Output Electron Energy Distribution of Microchannel Plates Rev. Sci. Instrum., 57 (3), 354 (1986).

Koshida et al. Narrow Energy Distribution of Output electrons from modified single channel electron multiplier, Rev. Sci. Instrum. 51 (3) Mar. 1980 pp. 365–368.

Japan, Pat. Abstract vol. 1, No. 57 E 76 Jpn Kokai No. 51-151062.

Scientific American vol. 245, No. 5, Nov. 1981 pp. 46–55.

R. L. Bell, Noise Figure of the MCP Image Intensifier Tube IEEE Trans. Elec. Dev. ED-22 No. 10 pp. 821–829 Oct. 1975.

Bjorkholm et al., X-ray Quantum Efficiency of Microchannel Plates, SPIE vol. 106, 189 (1977).

Galloway et al. Radiation Dose at the Silicon-Sapphire Interface due to Electron-Beam Aluminization, J. Appld. Phys. (49) 4, 2586 (1978).

Bardes et al. Detection of Soft X-rays with NEA III-V Photocathodes, Rev Sci Instrum. 49(9), 1273 (1978).

H. K. Pellehn, Image Intensifiers, Appld Oties & Optical Engineering, vol. VI, 399 Academic Press (1980).

*Primary Examiner*—P. Austin Bradley
*Assistant Examiner*—Jeffrey T. Knapp
*Attorney, Agent, or Firm*—Stanley Z. Cole

[57] ABSTRACT

A method of manufacturing a low noise microchannel plate which limits feedback includes creating a conductive layer on the output side of the microchannel plate so that portions of the open areas in the output end are closed off.

10 Claims, 9 Drawing Sheets

METHOD OF MANUFACTURING A FEEDBACK LIMITED MICROCHANNEL PLATE

This is a division of an application for Feedback Limited Microchannel Plate and Apparatus and Method, Ser. No. 07/724,041, filed Jul. 1, 1991, in the name of Aebi and Costello as inventors, now U.S. Pat. No. 5,268,612 which issued on Dec. 7, 1993.

GENERAL PURPOSE OF THE INVENTION

This invention results in an improved Microchannel Plate (MCP) which allows a lower noise figure proximity-focussed image intensifier to be fabricated than is possible using present state of the art MCPs. Scintillation noise is substantially reduced from prior art image intensifiers. This is a result of limiting the magnitude of x-ray, optical, and ion feedback from tube components on the output side of the MCP to the photocathode or MCP channel walls.

BACKGROUND OF THE INVENTION AND PRIOR ART

Microchannel plates are, for example, an essential component for fabrication of wafer tube image intensifiers. FIGS. 1–4 illustrate standard prior art devices and their operation. As shown in FIG. 1 a proximity-focussed wafer tube image intensifier 10 includes an input window 12 of glass or a fiber optic face plate onto the back of which is applied a photocathode 14. The microchannel plate 16 is spaced from and mounted parallel with the photocathode 14, and down stream of the microchannel plate 16 a phosphor screen 20 is provided on an output window 18 in the form of another fiber optics faceplate or glass. The input window 12 and output window 18 are mounted on opposite ends of a vacuum housing 22 with the microchannel plate 16 contained therebetween within the vacuum housing. The tube is provided with electrical leads for applying appropriate desired voltages to the photocathode 14, an input electrode 24 (see FIG. 2) on the front and an output electrode 26 (see FIG. 2) on the back of the microchannel plate 16 and phosphor screen 20.

The three main components of a wafer tube 10 are the photocathode 14, the microchannel plate 16, and the output phosphor screen 20. The photocathode 14 converts incident photons into photoelectrons. Generation-II wafer tubes use an alkali antimonide, positive affinity, photocathode. Generation-III wafer tubes use a GaAs, negative electron affinity, photocathode. The microchannel plate 16 serves as a high resolution electron multiplier which amplifies the photoelectron image. As used in an image intensifier the MCP typically has an electron gain of 100–1000. The amplified signal is accelerated by a 6 kv bias into the phosphor screen 20 which converts the electron energy into output light allowing the image to be viewed.

The microchannel plate 16 as shown enlarged in FIG. 2 consists of an array of miniature channel multipliers 28 of hollow glass fibers fused together and surrounded by a solid, glass border ring 30. As shown in FIG. 3 each channel multiplier 28 detects and amplifies incident radiation and particles such as electrons or ions. The channel multiplier concept is based on the continuous dynode electron multiplier first suggested by P. T. Farnsworth, U.S. Pat. No. 1,969,399. The channel multiplier 28 consists of a hollow tube coated on the interior surface by a secondary electron emitting semiconductor layer 32. This layer 32 emits secondary electrons in response to bombardment by electromagnetic radiation or particles such as electrons. The input and output metal electrodes 24 and 26 are provided on each end of the tube 28 to allow a bias voltage to be applied across the channel. This bias voltage creates an axial electric field which accelerates the emitted secondary electrons down the channel 28. The secondary electrons strike the wall again releasing additional secondary electrons. This process repeats as the electrons are accelerated down the channel. This results in amplification of the input photon or particle. A large pulse of electrons is emitted from the output end of the channel 28 in response to the input photon or particle.

In the typical microchannel plate 16, channel diameters can be as small as a few microns. For image intensification devices channel diameters are typically 10–12 microns. The channels typically have a length to diameter ratio of 40. The channel axes are typically biased at a small angle (5°) relative to the normal to the MCP surface. The bias angle ensures that ions generated at the tube anode cannot be accelerated down the channel, but strike the channel wall near the back of the MCP. This reduces ion feedback noise in the MCP and eliminates ion feedback from the phosphor screen to the photocathode.

A typical plate may contain an active region 18 mm in diameter and contains over a million channels. The plate is fabricated from a glass wafer. The wafer is cut from a boule formed by fusing together glass fibers. The glass fibers are composed of a core glass surrounded by a clad glass of a different composition. After the glass wafers are sliced from the boule, the core glass is removed by a selective etching process thus forming the hollow channels. The plates are fired in hydrogen which reduces the exposed glass surface thereby forming a semiconducting layer on the channel wall surface. The thin silica layer 32 resides on the semiconducting layer forming the secondary electron emissive surface.

Traditionally, the input and output electrodes 24 and 26 are formed on each surface of the plate by deposition of a thin metallization layer. The layers thickness is typically on the order of 800 Å for the input electrode 24 and 1100 Å for the output electrode 26. FIG. 4 is an electron microscopic view of a cross sectioned MCP in the region of the output electrode. The metallization thickness (1100 Å) is so thin relative to the channel diameter (10 microns) as to not be visible in the photograph. Nichrome or inconel are the commonly used electrode materials. These materials are used because of their good adhesion to the glass surface of the MCP.

The input electrode 24 is deposited by vacuum evaporation with a collimated beam of metal atoms. The beam is incident at a steep angle relative to the MCP surface to minimize penetration of the metal down the MCP channels. The MCP is rotated during the metallization process to result in uniform coverage of the plate surface and penetration of the channel. The practical limit is one half of a channel diameter penetration of the metal down the channel. It is desirable to limit the channel penetration as the commonly used metals, inconel or nichrome, have a very low secondary electron emission coefficient. If the primary particle or photon strikes the metallized channel wall a secondary electron may not be generated. Thus the gain of the MCP is lowered. More importantly the noise performance of the MCP suffers as some of the primary particles are not detected if they strike the metallized channel wall. The noise performance of the MCP is also degraded by the broad single particle gain distribution which results from the variation in gain depending upon whether the primary particle strikes the input metallization 24 or the secondary electron emitting layer 32.

The output electrode 26 is also deposited by vacuum evaporation with a collimated beam of metal atoms. In this case the incident angle is adjusted along with the MCP rotation to allow deeper penetration of the channel by the metal. Typically the metal penetrates 1.5 to 3.0 channel diameters. This is known as endspoiling to those familiar in the art of MCP manufacture. The gain of the MCP is reduced by this procedure. However this gain reduction is more than offset by other, desirable, characteristics which result from this procedure for MCPs which are used in image intensifiers. In particular, the output electron energy distribution of endspoiled MCPs is much more uniform than from plates with no endspoiling as described by N. Koshida "Effects of Electrode Structure on Output Electron Energy Distribution of Microchannel Plates", Rev. Sci. Instrum., 57(3), 354 (1986). This allows image intensifiers with higher resolution to be manufactured with end spoiled MCPs due to the improved electron optics which result from the uniform output electron energy distribution.

The improved emitted electron energy distribution which results from endspoiling is due to the fact that the majority of the emitted electrons are secondaries from the metallized channel walls which form the endspoiled region. These secondaries are given off when an electron emitted from farther up the channel is accelerated down the channel by the axial electric field and strikes the metallized region at the output of the channel. The axial electric field in the endspoiled region is zero due to the high conductivity of the metal. Therefore the emitted electrons are not accelerated after emission resulting in a more uniform emitted electron energy distribution.

The noise performance of an image intensifier is critical to its usefulness as a low light level imager. The noise performance is typically characterized by the noise factor, $K_f$, of the image intensifier. The noise factor of an image intensifier has been considered to be largely determined by the noise performance of the MCP in the past. The noise factor can be defined by the following equation.

$$K_f = \frac{SNR_{in}}{SNR_{out}}$$

SNR is the signal-to-noise power ratio. $SNR_{in}$ is the SNR of the input electron flux to the MCP. In an image intensifier this is also the SNR of the photoelectron flux from the photocathode. $SNR_{out}$ is the SNR of the output photon flux from the image intensifier phosphor screen. Both ratios are measured over the same noise bandwidth. The noise factor can also be defined where $SNR_{out}$ is the SNR of the output electron flux from the MCP. In this instance the noise factor is that of the MCP alone. The noise factor results presented in this disclosure are given in terms of that for an image intensifier where $SNR_{in}$ is for the photoelectron flux from the photocathode and $SNR_{out}$ is for the photon flux from the intensifier phosphor screen.

The noise performance of a MCP based image intensifier can be further degraded by various feedback mechanisms. The feedback mechanisms which generate noise that have been considered in the past relate to internally generated ion feedback in the MCP or optical photon feedback from the phosphor screen as described by R. L. Bell "Noise Figure of the MCP Image Intensifier Tube", IEEE Trans. Elec. Dev. ED-22, No. 10, pages 821–829, October (1975). These ions can generate noise pulses when accelerated back toward the MCP input where secondary electrons are generated when the ions strike the channel wall. In the case of a Gen-II image intensifier the ions may be accelerated to the photocathode generating secondary electrons. In the Gen-III technology ion feedback from the MCP to the photocathode has been eliminated by applying a thin (50–100 Å) film over the MCP input as described by H. K. Pollehn, "Image Intensifiers" Applied Optics and Optical Engineering, Vol. VI, 399, Academic Press, (1980). This film is semi-transparent to the photoelectrons, but will stop ions from bombarding the photocathode.

Optical photon feedback is avoided in a prior art image intensifier by ensuring that the aluminum metallization layer, which forms the anode of the tube and coats the phosphor, is sufficiently thick to completely stop penetration of light generated by the phosphor screen. This technique is effective and generally eliminates any significant feedback by optical photons to the MCP or photocathode. Optical photons, because of their low energy (2–3 eV), can also generate no more than one photoelectron upon impact with the MCP input or photocathode and thus cannot cause the large scintillations observed in an image intensifier. Phosphor screen to MCP wall ion feedback is somewhat limited in the prior art via the 5° bias angle used by prior art MCPs.

DISADVANTAGES OF PRIOR ART

In the prior art it has been noted that the noise factor of an image intensifier generally increases as the photocathode sensitivity increases for a given tube process. This increase in noise factor degrades the improvement in SNR from that which would be expected due to the increase in cathode photoresponse, and this increase in noise factor is particularly evident with the more sensitive GaAs photocathodes used with the Gen-III image intensifier technology. The increase in noise factor with increasing photoresponse measured for a typical Gen-III image intensifier is illustrated in FIG. 5. One cause of this increase is now understood to be caused by feedback mechanisms from the phosphor screen in the image intensifier. In particular, x-ray feedback is now shown to be a significant feedback mechanism in a Gen-III image intensifier and an important contributor to the noise factor of a Gen-III image intensifier Prior art image intensifiers also suffer from large scintillation light pulses which tend to degrade the image and contribute significantly to the noise factor of the tube. These scintillations have been attributed to ion feedback within the MCP and to the photocathode in the past. The new mechanism of x-ray feedback from the anode to the MCP channel wall or photocathode is now discovered by this invention to be a major source of these scintillations.

The electrons emitted from the MCP are typically accelerated to an energy of 6 keV before striking the anode and exciting the phosphor. Most of the electron energy is converted to light or is lost to thermal vibrations of the aluminum and phosphor target. A small fraction of the energy is converted to x-rays. This fraction is on the order of 0.01% of the incident electron energy.

About half of the x-ray energy is emitted at the characteristic K-alpha lines of the target material as reported by K. F. Galloway et al, "Radiation Dose at the Silicon-Sapphire Interface due to Electron-Beam Aluminization" J. Appl. Phys., 49(4), 2586 (1978), in particular at the K-alpha line of aluminum (1.487 KeV) for an aluminized phosphor screen. The ZnCdS used in the P-20 phosphor which is standard for an image intensifier used for night vision applications will have higher order characteristic x-ray lines when bombarded with the typical 6 keV electron energy used in an intensifier. The sulfur will have a characteristic K-alpha line at 2.3 keV. Zinc will have a number of higher order characteristic lines below 1.1 keV, while cadmium will have a number of higher order lines near 3.5 keV. The rest of the x-rays have a continuous or bremsstrahlung spectrum of energy up to the bombardment energy of the electron, 6 keV in this example.

A GaAs photocathode is a very efficient x-ray detector as reported by D. Bardas et al, "Detection of Soft X-rays with NEA III-V Photocathodes" Rev. Sci. Instrum., 49(9), 1273 (1978). An aluminum K-alpha x-ray will cause the emission of 60 or more photoelectrons resulting in a bright scintillation on the phosphor screen and a higher noise factor. The large number of photoelectrons created per absorbed x-ray causes the large contribution to noise factor by x-ray feedback. The number of emitted photoelectrons is a function of the x-ray energy and the electron escape probability into vacuum from the photocathode.

X-ray transmission through the MCP to the photocathode is important for the above feedback process to the photocathode to be significant in an image intensifier. Significant x-ray transmission through a MCP has been reported by P. I. Bjorkholm et al, "X-ray Quantum Efficiency of Microchannel Plates" SPIE Vol. 106, 189 (1977). Bjorkholm showed that at glancing angles a significant fraction of the incident x-rays are transmitted through a MCP. The transmitted x-rays are those incident on the MCP at an angle of less than 2°–10°. As the x-ray energy increases, the angle of incidence required for transmission decreases as discussed by Bjorkholm. Transmission for a 2° angle of incidence or less results in transmission of 0.0025 of the incident x-rays through the MCP. This level of x-ray transmission is significant as the MCP gain can be in the range of 500–1000 which increases the number of generated x-rays per photoelectron emitted from the cathode.

A model has been developed for the noise factor resulting from x-ray generation at the anode of a MCP containing Gen-III wafer tube. The model is meant to illustrate the general trends expected from x-ray feedback to the photocathode. It is not intended to be an exact model as all of the required parameters of a system may vary from the specifics of this model.

The model includes x-ray generation for an aluminum anode as a function of electron bombardment energy, electron generation in a GaAs photocathode as a function of x-ray energy and GaAs thickness, and electron escape probability from the photocathode surface. MCP x-ray transmission and MCP gain are also included in the model. A MCP x-ray transmission factor of 0.0025 and a MCP gain of 750 are used in the model results presented in this disclosure. The baseline noise factor of a filmed MCP, not including the contribution from x-ray feedback, is assumed to be 3. This factor is primarily due to the 62% open area ratio of the MCP. Electrons which strike the electrode area between channels are typically not detected by a filmed MCP. The GaAs cathode thickness used in the model is 1.5 microns. These parameters are used to calculate the noise factor contribution due to x-ray feedback in an image intensifier.

The model predicts an increase in noise factor with photocathode sensitivity (FIG. 6). This corresponds with the experimental data presented in FIG. 5. The calculated electron generation rate in a 1.5 micron thick GaAs layer is shown in FIG. 7 as a function of x-ray bombardment energy. The number of electrons generated peaks at an x-ray bombardment energy of approximately 2.4 keV. Higher x-ray bombardment energies results in the generation of fewer electrons in the GaAs layer as most of the x-rays are transmitted through the layer, Thus a GaAs cathode has close to peak sensitivity for x-rays near the characteristic lines generated by electron bombardment of an aluminized phosphor screen by 6 keV electrons.

The model also correctly predicts the functional dependance of the noise performance of a Gen-III image intensifier as a function of applied bias voltage and photocathode sensitivity. The effect on noise factor of increasing the MCP-to-phosphor screen bias voltage with photocathode sensitivity as a parameter is shown in FIG. 8. Noise factor as a function of MCP bias voltage is modelled in FIG. 9 with photocathode sensitivity as a parameter. FIG. 10 is data for noise factor versus screen bias voltage for a Gen-III image intensifier with photocathode photoresponse a parameter, FIG. 11 is data taken from the same image intensifier as a function of MCP bias voltage. Again photocathode photoresponse is a parameter, The data in FIGS. 10 and 11 shows the same functional dependance as the model results shown in FIGS. 8 and 9, The above experimental results show strong support for the hypothesis that x-ray feedback is an important contributor to the noise factor of a MCP containing image intensifier. The data also shows that this effect increases in importance as the photocathode sensitivity to x-rays increases. Thus this effect will be more important in the Gen-III technology which uses the more sensitive GaAs photocathode. This photocathode is more sensitive to x-rays due to its larger electron escape probability compared to previous photocathodes and also is a result of its much greater thickness. A GaAs photocathode is typically 10–50 times thicker than a positive affinity photocathode and will absorb a proportionately greater number of x-rays, thus generating electrons which can then be emitted, resulting in a higher noise factor.

It should also be noted that the above feedback mechanism is independent of input light level. The increased noise factor due to x-ray feedback will be present at any input signal level to the MCP.

A further disadvantage of the prior art is the use of inconel or nichrome as the input and output electrode metallization material. These materials have very low secondary electron emission coefficients. This reduces the gain of the plate as electrons which strike the inconel or nichrome typically yield less than one secondary electron. This lowers the gain of the MCP.

SUMMARY OF THE INVENTION

The object of this invention is to provide a microchannel plate apparatus and method which limit feedback of photons, ions, or neutral particles from the output side of the plate.

Another object of this invention is to provide a microchannel plate which limits transmission of photons, ions, or neutral particles from the output side of the plate through the plate where they could impact the photocathode generating a noise pulse.

In accordance with one aspect of the present invention, the open area of the output end of the channels of the MCP is reduced relative to an endspoiled MCP of the prior art. The added noise due to feedback effects from the screen to the MCP will be reduced proportional to the reduction in output open area of the MCP. Reduction of the output open area by less than 10% would be ineffective in producing a significant reduction in noise factor. The maximum reduction in output open area must be less than 100%, which would completely close off the channels, as some opening must remain to allow the electrons to escape the MCP. A reduction in the range from about 10% to about 85% has resulted in a useful compromise between the two extremes described above. In general, a reduction at the higher end of this range is most effective in carrying out this invention.

In accordance with another aspect of the present invention, the open area at the output end of the channels is reduced by depositing a layer of aluminum which is at least 10 percent of the open area of the output end of the channels and preferably is substantially 75–85% percent of the open area of the channels.

In accordance with another aspect of the present invention the microchannel plate electrodes and channel walls may be provided with a textured surface to reduce x-ray transmission via reflection.

A further object is to provide input and output metallization materials on the plate which will act as electrodes which have a higher secondary .emission coefficient than the commonly used inconel material.

In accordance with another aspect of this invention, metallized layers of aluminum are provided at both the input and output ends of the channels of the microchannel plate.

DESCRIPTION OF THE PREFERRED EMBODIMENTS

Figure 12:
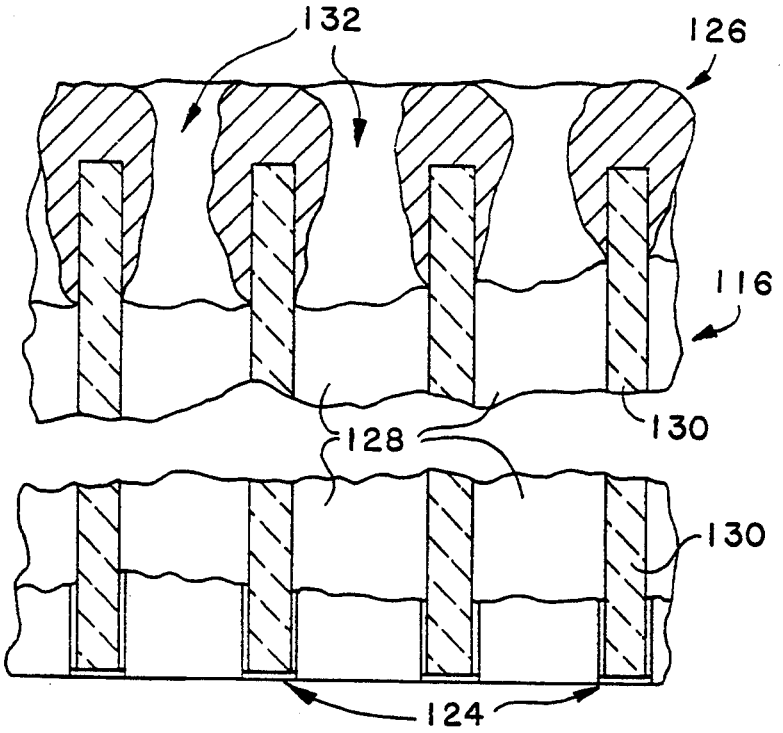
FIG. 12 is an enlarged foreshortened view of a microchannel plate in accordance with the present invention.
Figure 13:
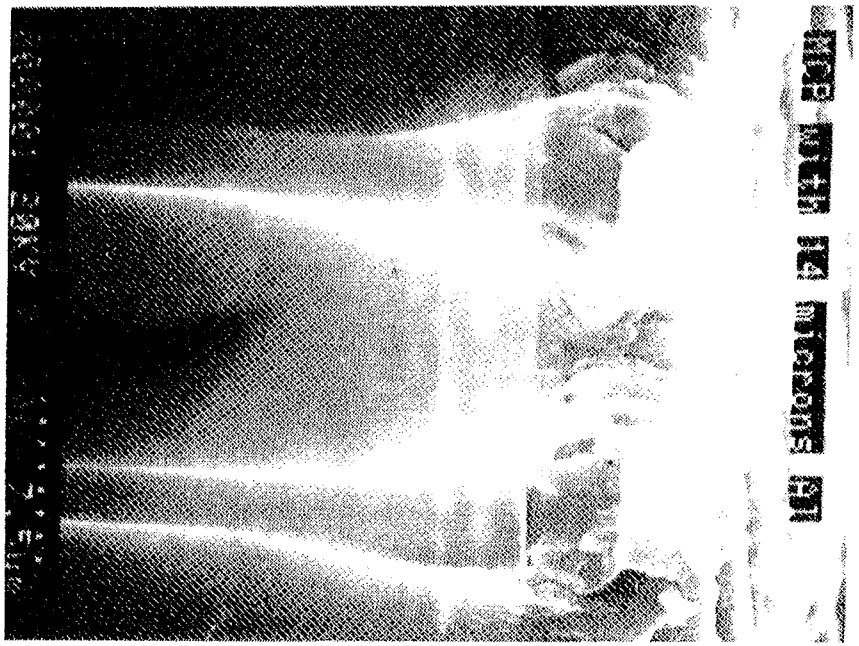
FIG. 13 is an electron microscopic partially prospective, elevational, sectional view of a microchannel plate made in accordance with the present invention.

In accordance with the preferred embodiment of the present invention as illustrated in FIGS. 12 and 13, an output electrode 126, preferably aluminum, is deposited on the output surface of the microchannel plate 116 to substantially close off the open area of the channels 128 formed by the channel walls 130.

It has been discovered that the number of photons (including x-rays), charged or neutral particles which can enter the channel from the region on the output side of the MCP can be reduced in at least the same ratio as the area ratio reduction between the normal open end of the output of the channel 128 and the reduced opening 132 resulting from the deposited output electrode on the output end of the channel. It has been discovered that this reduction in the number of photons or particles which can enter the plate reduces the noise generated by feedback of these photons or particles to the MCP input region or to a photocathode 14 which may exist in the region in front of the MCP input. The number of bright flashes or scintillations observed on the phosphor screen at low light levels are reduced in an image intensifier utilizing the improved MCP of this invention.

In accordance with this invention, the output channel area of the MCP is reduced by at least 10% and preferably reduced by substantially 75 to 85 percent by applying a much thicker metallization layer for the output electrode of the microchannel plate than is customary. The typical metallization thickness used for the output electrode is 1100 Å (i.e., 0.11 microns). In accordance with this invention, for a MCP with 10 micron diameter channels and a 12.5 micron center-to-center channel spacing, a layer of aluminum 7 microns thick is applied to the MCP surface via standard thin film deposition procedures familiar to those knowledgeable in the art. For example, the electrode material can be applied to the MCP at an incident angle of 60°–70° to the MCP while rotating the MCP. In this example, the channel output open area is reduced to approximately 25 percent of that of a normally processed MCP. It has been found that the photon, charged or neutral particle transmission of the plate is reduced by a similar percentage.

Figure 5:
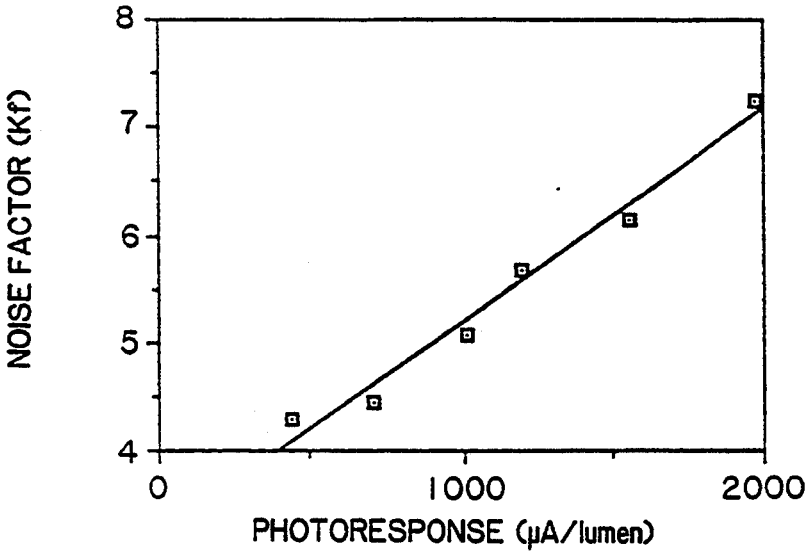
FIG. 5 is a typical plot of noise factor versus photoresponse for a Gen-III image intensifier containing a prior art MCP.
Figure 6:
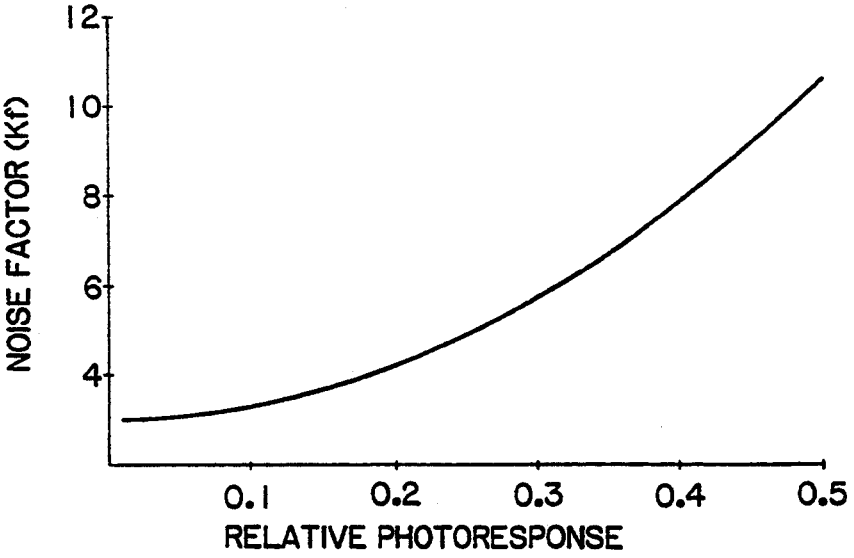
FIG. 6 is a plot of the modelled Noise Factor vs relative photoresponse for a typical Gen-III image intensifier containing a prior art MCP.
Figure 7:
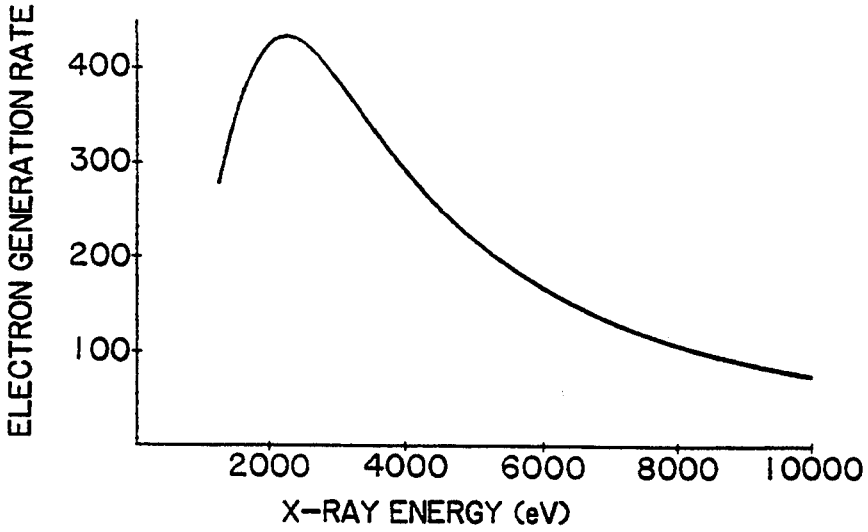
FIG. 7 is a plot of the electron generation rate per incident x-ray photon in a 1.5 micron thick GaAs layer versus x-ray energy.
Figure 8:
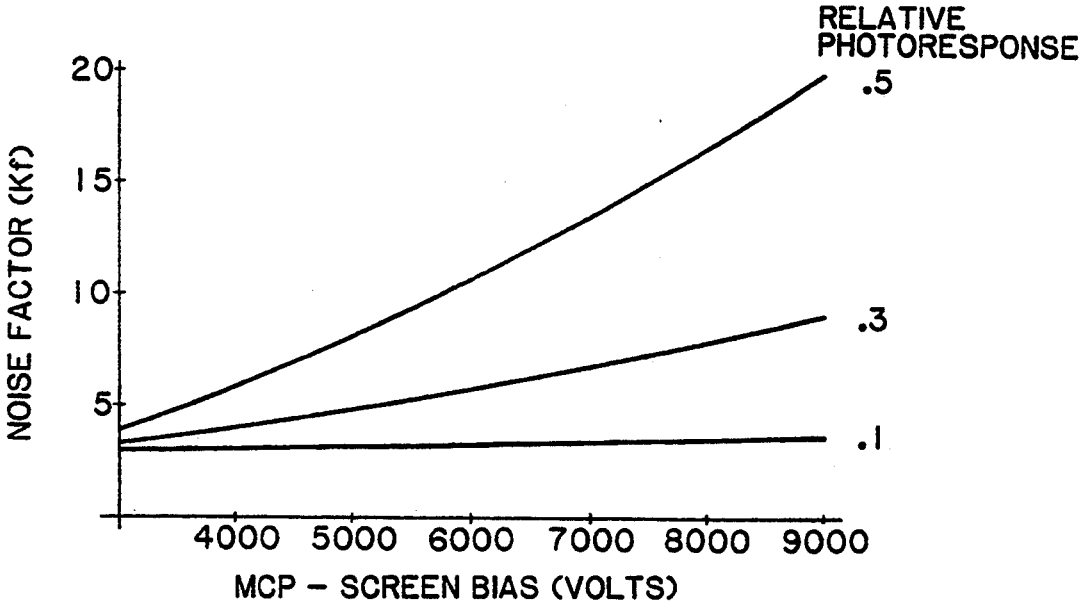
FIG. 8 is a plot of the modelled Noise Factor vs MCP-to-screen bias voltage for a typical Gen-III image intensifier containing a prior art MCP with cathode photoresponse a parameter.
Figure 9:
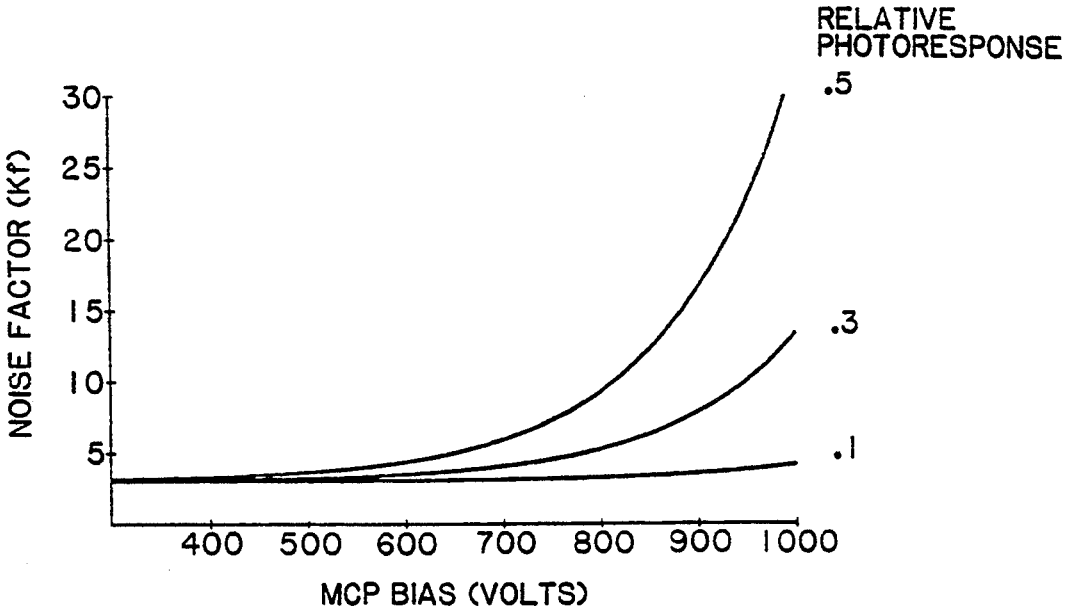
FIG. 9 is a plot of the modelled Noise Factor versus MCP bias voltage for a typical Gen-III image intensifier containing a prior art MCP with cathode photoresponse a parameter.
Figure 10:
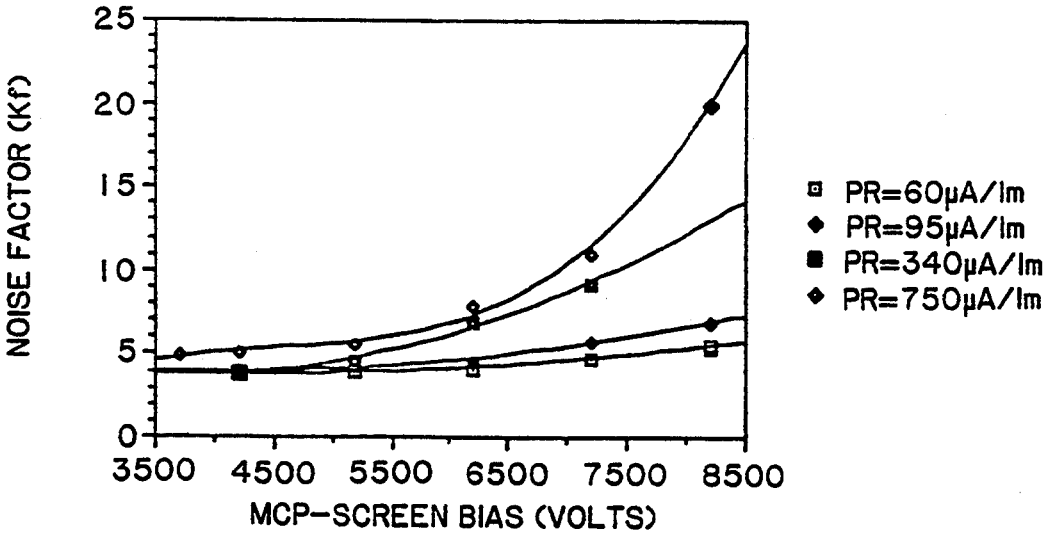
FIG. 10 is a plot of Noise Factor versus MCP-to-screen bias voltage for a typical Gen-III image intensifier containing a prior art MCP with cathode photoresponse a parameter.
Figure 11:
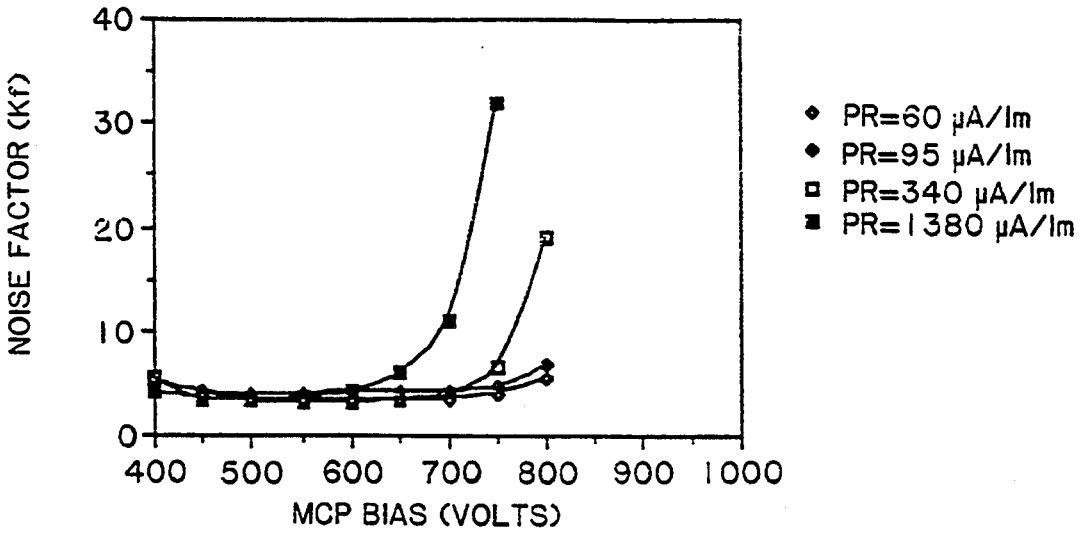
FIG. 11 is a plot of Noise Factor versus MCP bias voltage for a typical Gen-III image intensifier containing a prior art MCP with cathode photoresponse a parameter.
Figure 14:
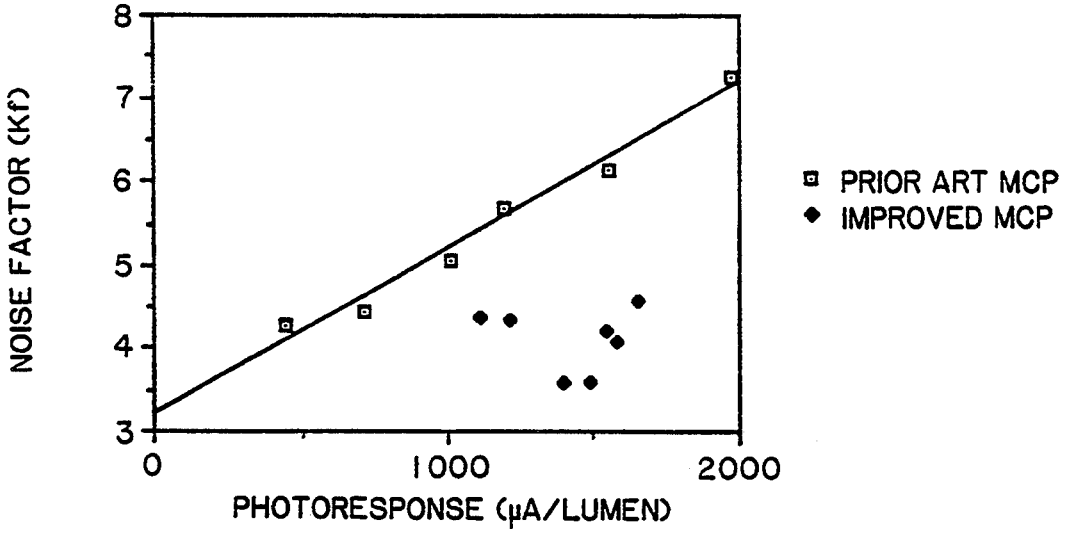
FIG. 14 is a plot of Noise Factor versus photoresponse for a Gen-III intensifier containing the improved MCP as compared with an intensifier containing a prior art MCP.
Figure 15:
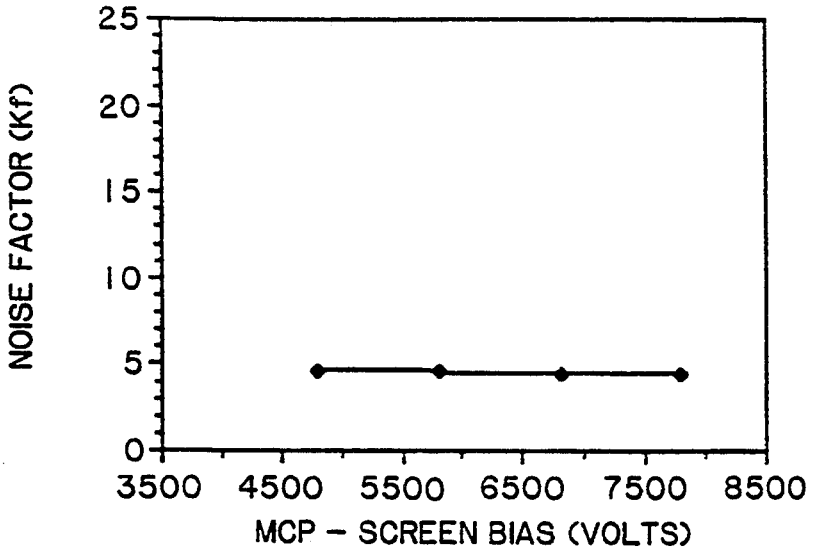
FIG. 15 is a plot of Noise Factor versus MCP to screen bias voltage for a Gen-III image intensifier containing an improved MCP of this invention with a cathode photoresponse of 1221 microamp/lumen.
Figure 16:
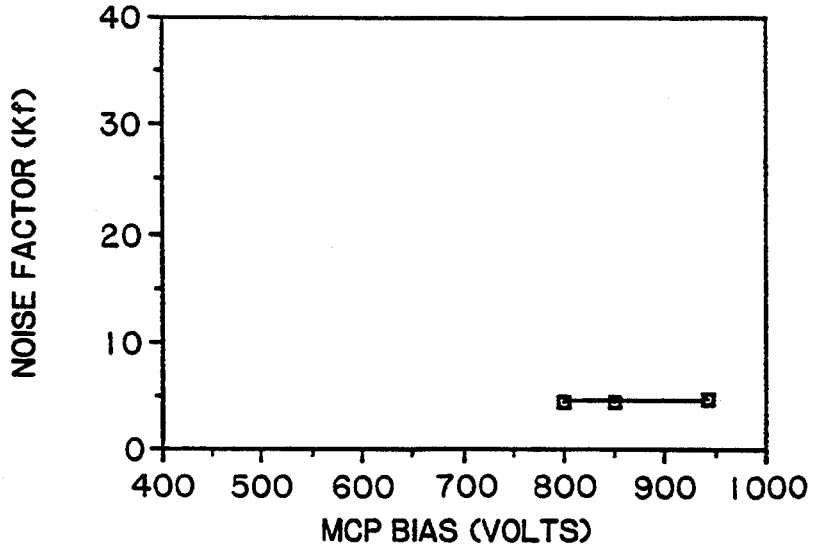
FIG. 16 is a plot of Noise Factor versus MCP bias voltage for a Gen-III image intensifier containing an improved MCP of this invention with a cathode photoresponse of 1652 microamps/lumen.

FIG. 14 compares the noise factors of a number of Gen-III image intensifiers containing the improved MCP of this invention with the prior art performance previously presented in FIG. 5. The improved MCPs had output open area reductions of 75–85 percent. The noise figure of the intensifiers containing the improved MCP is no longer a function of the photocathode sensitivity as was the case for intensifiers containing prior art MCPs. A plot of noise factor versus MCP-to-screen bias voltage is shown in FIG. 15. Noise factor now decreases with MCP-to-screen bias voltage and is much less than in prior art intensifiers (FIG. 10). FIG. 16 is a plot of noise factor versus MCP bias for the improved MCP of this invention. Again the noise factor is much less than that in a prior art intensifier with similar photoresponse and operated at similar bias voltages (FIG. 11). These results along with the model results presented previously in this disclosure show that the improved MCP now disclosed significantly reduces the noise when photons or particles on the output side of the MCP penetrate the MCP.

Figure 1:
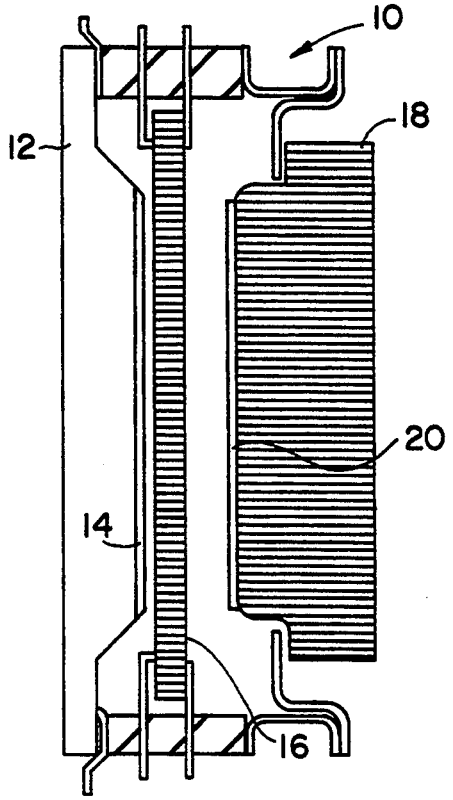
FIG. 1 PRIOR ART
FIG. 1 is a schematic, elevational, sectional view of a prior art wafer tube image intensifier.
Figure 2:
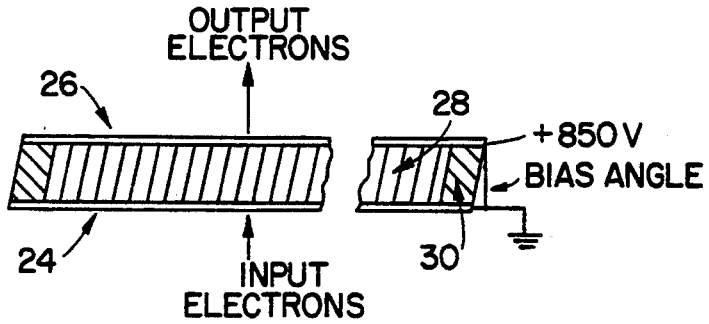
FIG. 2 PRIOR ART
FIG. 2 is an enlarged, foreshortened view of a prior art microchannel plate.
Figure 3:
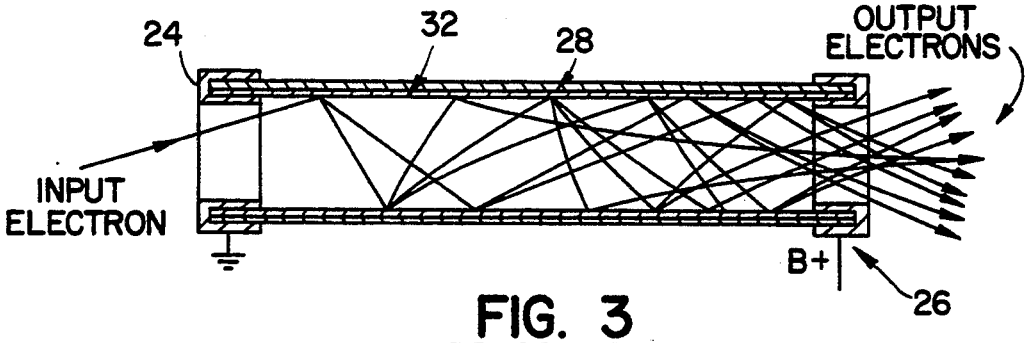
FIG. 3 PRIOR ART
FIG. 3 is an enlarged schematic view of a single channel multiplier taken from a microchannel plate of the prior art.
Figure 4:
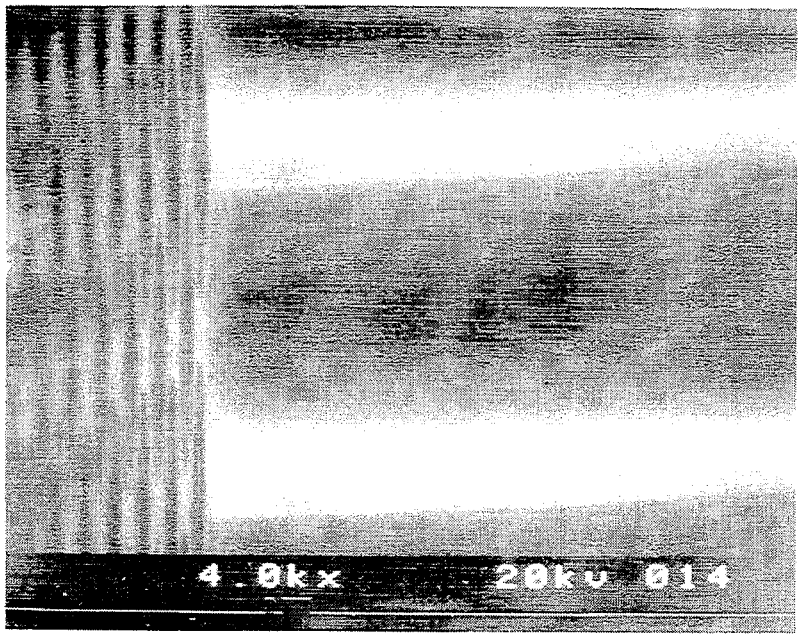
FIG. 4 PRIOR ART
FIG. 4 is an electron microscopic partially prospective, elevational, sectional view of the output portion of a microchannel plate of the prior art.
Figure 17:
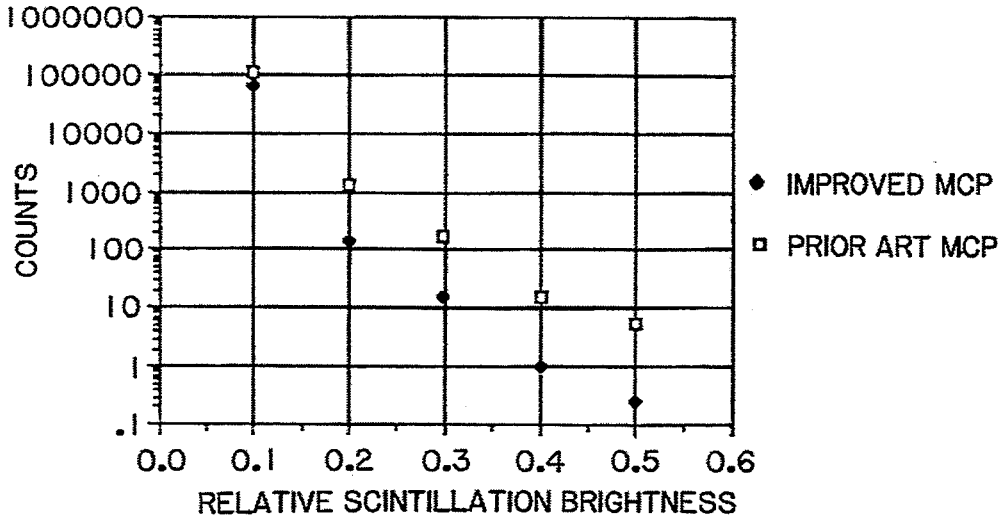
FIG. 17 is a plot of the number of scintillations observed versus scintillation brightness for a Gen-III image intensifier containing a prior art MCP as compared to a Gen-III intensifier containing an improved MCP of this invention.

FIG. 17 compares the number of scintillations observed on the phosphor screen of an image intensifier containing a typical prior art MCP with an image intensifier containing an MCP fabricated as described in this disclosure with a 75 percent reduction in output channel open area. The number of bright scintillations is reduced by approximately an order of magnitude for the tube containing the improved MCP as compared to the tube with the prior art MCP.

By modifying the output open area tradeoffs in gain and noise factor can be engineered allowing optimization of the MCP for a given application. As the ultimate limit of complete closure of the output channel opening is approached, reduction of MCP gain at a given bias voltage will become evident as the amplified electrons will no longer be able to escape the channel. Conductance through the plate will also become limited reducing the ability to normally process and outgas the MCP. At the other limit of little or no reduction in MCP output channel open area feedback of particles or photons into the plate will not be limited. A 10 percent or greater reduction in output channel open area is required to significantly reduce feedback of particles or photons. The optimum area reduction for a given application will be determined by the MCP gain required for the application balanced against the required reduction in feedback of photons or particles into the plate.

The microphotographic view of FIG. 13 shows the deposited electrode on the output surface of a microchannel plate. This view shows the texture of the deposited electrode surface. The texture provided to the surface by the thin film deposition of the aluminum electrode is believed to further reduce the x-ray transmission of a microchannel plate. This is a result of the reduction in specular reflection of x-rays which strike the textured electrode surface.

An alternate embodiment of this invention consists of texturing the surface of the channels. This texturing greatly reduces the x-ray transmission of a MCP. Most of the soft x-rays transmitted by a MCP .are a result, it is believed, of specular reflection of the x-rays by the channel walls at glancing angles up to 10° from the normal to the MCP surface depending upon x-ray energy. By roughening the channel wall surface most of the x-rays are absorbed in the channel wall and are not transmitted through the plate to the photocathode where a noise pulse would be generated.

The output electrode is preferably fabricated with a relatively malleable metal. Such metals include gold or aluminum. A malleable metal can be applied in very thick layers without problems of peeling or flaking. The standard metals such as inconel or nichrome which are typically used as MCP electrode material peel or flake due to the severe stress present in thick films of these materials when deposited by evaporation and are thus not preferred metals for this application.

Aluminum is a more preferred metal. Typically, a very thin (on the order of 60 Å) layer of $Al_2O_3$ forms on its surface after air exposure. This oxide is a relatively good secondary electron emitter compared to the prior art surfaces formed on inconel of nichrome. Electrons which strike the $Al_2O_3$ surface of this invention generate more than one secondary electron thus increasing the gain of the modified MCP relative to an MCP with similar electrodes formed of nichrome or inconel. The prior art surfaces which result with inconel or nichrome typically generate less than one secondary electron per incident primary electron.

In accordance with another aspect of the preferred embodiment of the present invention, advantage is taken of the higher gain obtained with aluminum metallization by using aluminum for the input electrode metallization 124, The use of aluminum favorably impacts both the MCP gain and noise factor as compared to the use of inconel or nichrome for the input MCP electrode metallization due to the higher secondary electron emission coefficient of $Al_2O_3$. The use of the same metal for both the front and back electrodes on the MCP also simplifies manufacture of the plate as both surfaces can be coated in the same piece of deposition equipment.

The microchannel plates and their method of manufacture in accordance with this invention allows fabrication of Gen-III image intensifier tubes with approximately 25% lower noise factor than Gen-III tubes containing a standard, filmed, MCP. These tubes also exhibit significantly lower scintillation noise than a standard tube. Furthermore, these tubes can be operated at higher gains than used in the past with less degradation in signal-to-noise ratio than would result with tubes containing MCPs of the prior art.

Although this invention has been described in terms of MCPs used in various forms of night vision tubes, it should be readily understood that the invention may be applied to advantage in other applications for MCPs such as instrumentation and the like where similar conditions and problems are encountered.

It should also be understood that various alternatives to the embodiment shown here may be employed in practicing the present invention. It is intended that the following claims define the invention and that the structure and methods within the scope of these claims and their equivalents be covered thereby.

We claim:

1. The method of making a multichannel plate comprising the steps of:

forming a boule of a multitude of optical fibers, each comprising a core glass surrounded by a cladding glass;

cutting the boule to form a plate member;

removing the core glass from the plate member to leave a multitude of channel members fused together, each channel member having a diameter of less than about 12 microns and having an input end and an output end;

forming a semiconductor layer on the channel wall surface; and, applying an output electrode of an aluminum layer on the output face of the channel plate by directing aluminum from a source at an angle of incidence relative to the output surface of said plate member as to result in said output electrode covering at least 10 percent of the open area of the output end of said channels.

2. The method of making a multichannel plate comprising the steps of:

forming a boule of a multitude of optical fibers, each comprising a core glass surrounded by a cladding glass;

cutting the boule to form a plate member;

removing the core glass from the plate member to leave a multitude of channel members fused together, each channel member having an input end and an output end;

forming a semiconductor layer on the channel wall surface; and, applying an output electrode of an aluminum layer on the output face of the channel plate by directing aluminum from a source at an angle of incidence between 60° and 70° relative to the output surface of said plate member to cause said output electrode to cover at least 10 percent of the open area of the output end of said channels.

3. The method of claim 2 including the step of depositing a layer of aluminum to the input surface of said microchannel plate to form an input electrode.

4. The method of claim 2 including the step of texturing said semiconductor layer.

5. The method of making a multichannel plate comprising the steps of:

forming a boule of a multitude of optical fibers each composed of a core glass surrounded by a cladding glass;

cutting the boule to form a plate member;

removing the core glass from the plate member to leave a multitude of channel members fused together, each channel member being less than about 12 microns in diameter and having an input end and output end;

forming a semiconductor layer on the channel wall surface; and applying an output electrode on the output face of the channel plate which electrode covers at least 10 percent of the open area of the output end of said channels.

6. The method of claim 5 wherein said step of applying the output electrode includes the step of applying a layer of aluminum on the output face of the channel plate.

7. The method of claim 5 wherein the step of applying the output electrode includes texturing the electrode surface.

8. The method of claim 5 including the step of texturing the said semiconductor layer.

9. The method of claim 5 wherein the step of covering the open area of the channels includes covering substantially 75 percent of the open area of the output end of the channels.

10. The method of claim 9 wherein the step of applying the output electrode includes texturing the electrode surface.

* * * * *